United States Patent [19]

Abbott

[11] Patent Number: 4,885,470

[45] Date of Patent: Dec. 5, 1989

[54] INTEGRALLY FORMED RADIO FREQUENCY QUADRUPOLE

[75] Inventor: Steven R. Abbott, Concord, Calif.

[73] Assignee: The United States of America as represented by the United States Department of Energy, Washington, D.C.

[21] Appl. No.: 104,026

[22] Filed: Oct. 5, 1987

[51] Int. Cl.[4] ..... H01J 39/36

[52] U.S. Cl. ..... 250/396 R; 250/294; 250/281

[58] Field of Search ..... 250/281, 282, 288, 294, 250/290, 291, 292, 293, 396 R

[56] References Cited

U.S. PATENT DOCUMENTS

| | | | |
|---|---|---|---|
| 3,128,432 | 4/1964 | Gordon | 250/293 |
| 3,457,404 | 7/1969 | Uthe | 250/283 |
| 3,553,451 | 1/1971 | Uthe | 250/290 |
| 3,725,700 | 4/1973 | Turner | 250/292 |
| 3,819,941 | 6/1974 | Carrico | 250/281 |
| 4,158,771 | 6/1979 | Beeck et al. | 250/281 |
| 4,160,744 | 8/1978 | Lawrence, Jr. et al. | 249/96 |
| 4,490,648 | 12/1984 | Lancaster et al. | 250/396 R |

*Primary Examiner*—Carolyn E. Fields
*Assistant Examiner*—John A. Miller
*Attorney, Agent, or Firm*—L. E. Carnahan; Roger S. Gaither; William R. Moser

[57] ABSTRACT

An improved radio frequency quadrupole (10) is provided having an elongate housing (11) with an elongate central axis (12) and top, bottom and two side walls (13*a–d*) symmetrically disposed about the axis, and vanes (14*a–d*) formed integrally with the walls (13*a–d*), the vanes (14*a–d*) each having a cross-section at right angles to the central axis (12) which tapers inwardly toward the axis to form electrode tips (15*a–d*) spaced from each other by predetermined distances. Each of the four walls (13*a–d*), and the vanes (14*a–d*) integral therewith, is a separate structural element having a central lengthwise plane (16) passing through the tip of the vane, the walls (13*a–d*) having flat mounting surfaces (17, 18) at right angles to and parallel to the control plane (16), respectively, which are butted together to position the walls and vane tips relative to each other.

2 Claims, 3 Drawing Sheets

INTEGRALLY FORMED RADIO FREQUENCY QUADRUPOLE

BACKGROUND OF INVENTION

This invention relates to radio frequency quadrupoles, and more particularly to an improved manner of constructing such devices. The United States Government has rights in this invention pursuant to Contract No. DE-AC03-76SF00098 between the U.S. Department of Energy and the University of California.

Radio frequency quadrupoles comprise four elongated electrodes opposing each other in pairs symmetrically disposed about a common axis and are used for the bunching, acceleration and focusing of particle beams passing along the common axis.

In operation, the voltage impressed on the electrodes is usually on the order of tens of thousands of volts. Typically, the electrode spacing is only a few millimeters. The shape of the electrodes and their relative positioning must be controlled with substantial accuracy to produce the desired quality and frequency of the quadrupole field along the length of the axis of the device.

Prior to the present invention, the radio frequency quadrupoles in use have been constructed from a number of separate parts, in combination, to make up the outer walls of the device and the elongated electrodes which are mounted on the inside surfaces of the walls. The assembly and adjusting of such units is quite complex and expensive, particularly when the device has a considerable length with the consequent difficulty of working in the interior of the device from the ends thereof. Iterative adjustments are usually required before the electrodes are finally positioned.

SUMMARY OF INVENTION

It is the primary object of the present invention to provide a radio frequency quadrupole with electrodes that are positioned relative to each other with substantial accuracy, and in which the quadrupole is relatively inexpensive in its construction and assembly.

Additional objects, advantages and novel features of the invention will be set forth in the description which follows, and in part will become apparent to those skilled in the art upon examination of the following, or may be learned by practice of the invention. The objects and advantages of the invention may be realized and attained by means of the instrumentalities and combinations pointed out in the appended claims.

To achieve the foregoing and other objects, and in accordance with the present invention, as described and broadly claimed herein, an improved radio frequency quadrupole is provided having an elongate housing with an elongate central axis and top, bottom and two side walls symmetrically disposed about the elongate axis, and a vane formed integrally with each of the four housing walls, the vanes each having a cross-section normal to the central axis which tapers inwardly toward the central axis to form electrode tips spaced apart from each other by predetermined distances.

A further aspect of the invention lies in the construction of the quadrupole wherein each of the four walls, and vanes integral therewith, is a separate structural element having a central lengthwise plane passing through the tip of the vane, and wherein the walls each have flat surfaces substantially at right angles to and parallel to the central plane which are butted against corresponding surfaces on the adjacent walls to position the walls and vane tips relative to each other.

BRIEF DESCRIPTION OF THE DRAWINGS

The accompanying drawings, which are incorporated in and form part of the application, together with the description, serve to explain the principles of the invention.

DESCRIPTION OF PREFERRED EMBODIMENT

Figure 1:
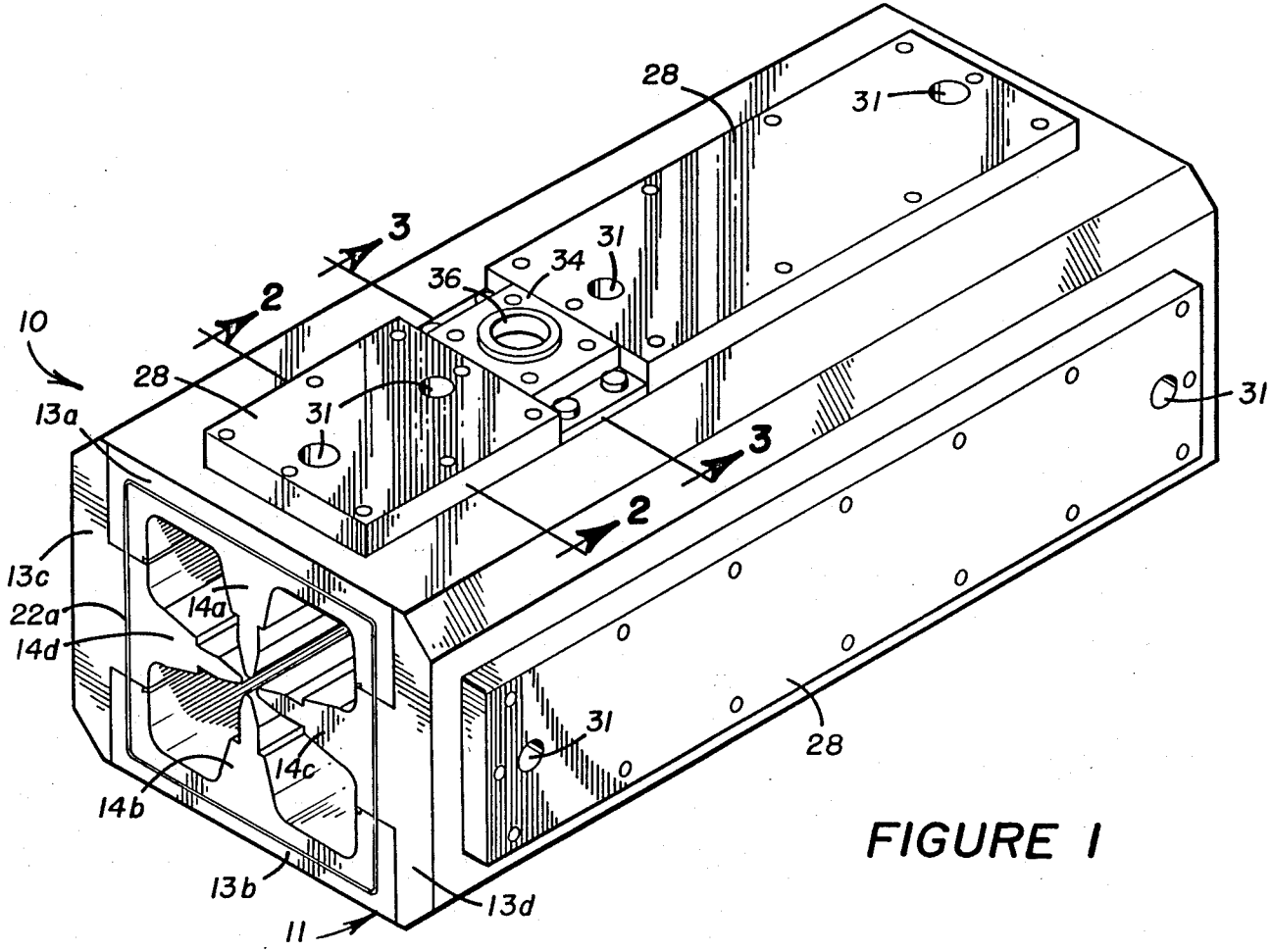
FIG. 1 is a perspective view of a radio frequency quadrupole constructed in accordance with the present invention.

Referring now to the drawings, wherein a preferred embodiment of the invention is illustrated, the radio frequency quadrupole 10 comprises an elongated housing 11 having an elongate central axis 12, and top, bottom and two side walls **13*a*, 13*b*, 13*c* and 13*d*, respectively, the walls being symmetrically disposed about the central axis 12**.

Figure 3:
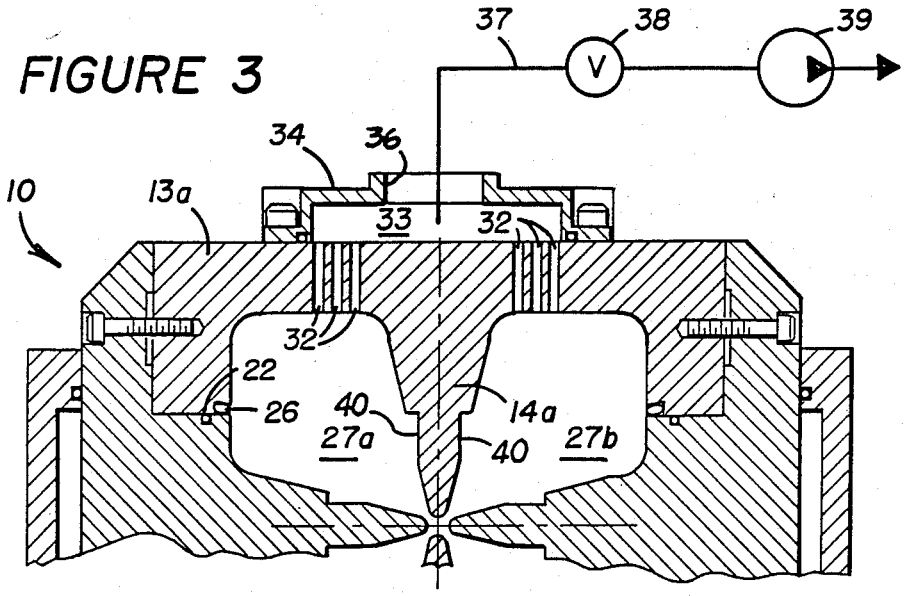
FIG. 3 is a partial cross-sectional view of the quadrupole, taken on line 3—3 of FIG. 1.
Figure 2:
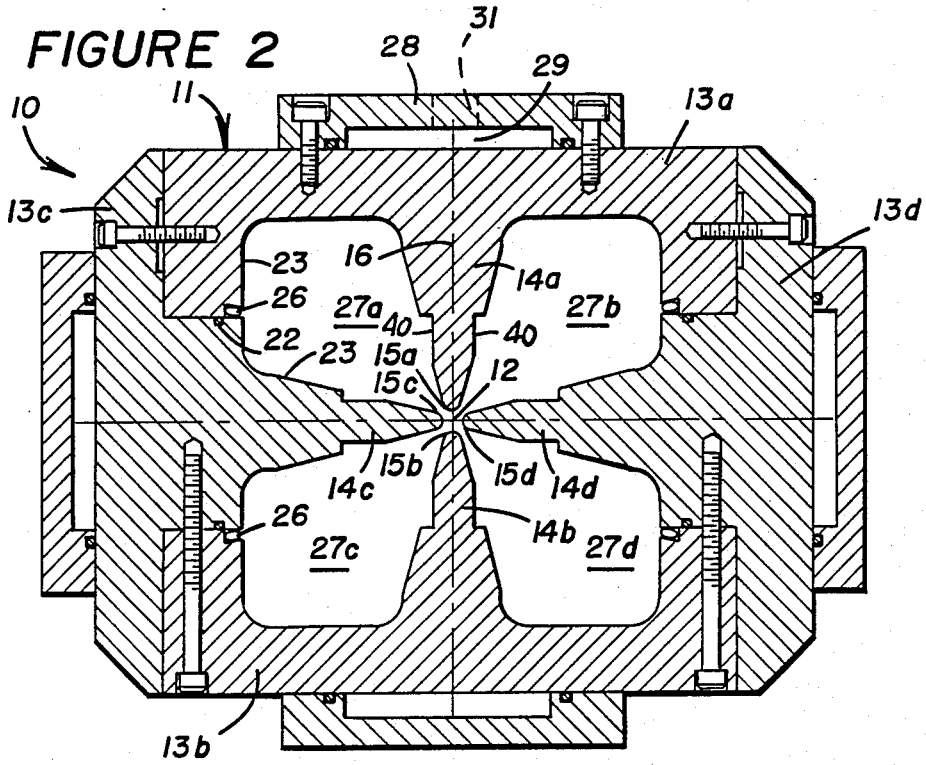
FIG. 2 is a cross-sectional view of the quadrupole, taken on line 2—2 of FIG. 1.

An upper vane **14*a* is formed integrally with and projecting from top wall 13*a*, the vane 14*a* extending substantially the length of the top wall and having a cross-section normal to the central axis, e.g., in the planes of FIGS. 2 or 3, which tapers inwardly towards the central axis to form a thin blade-shaped electrode tip 15*a* spaced from the axis 12 by a predetermined distance. In like manner, vanes 14*b*, 14*c* and 14*d* are formed integrally with and projecting from the bottom wall 13*b* and the side walls 13*c* and 13*d*, respectively. The electrode tips 15*a* and 15*b* form a first pair of thin blade-shaped confronting tips spaced apart by a first predetermined distance, while the electrode tips 15*c* and 15*d*** form a second pair of thin blade-shaped confronting electrode tips spaced apart by a second predetermined distance and at substantially right angles to the first pair of electrode tips.

Figure 4:
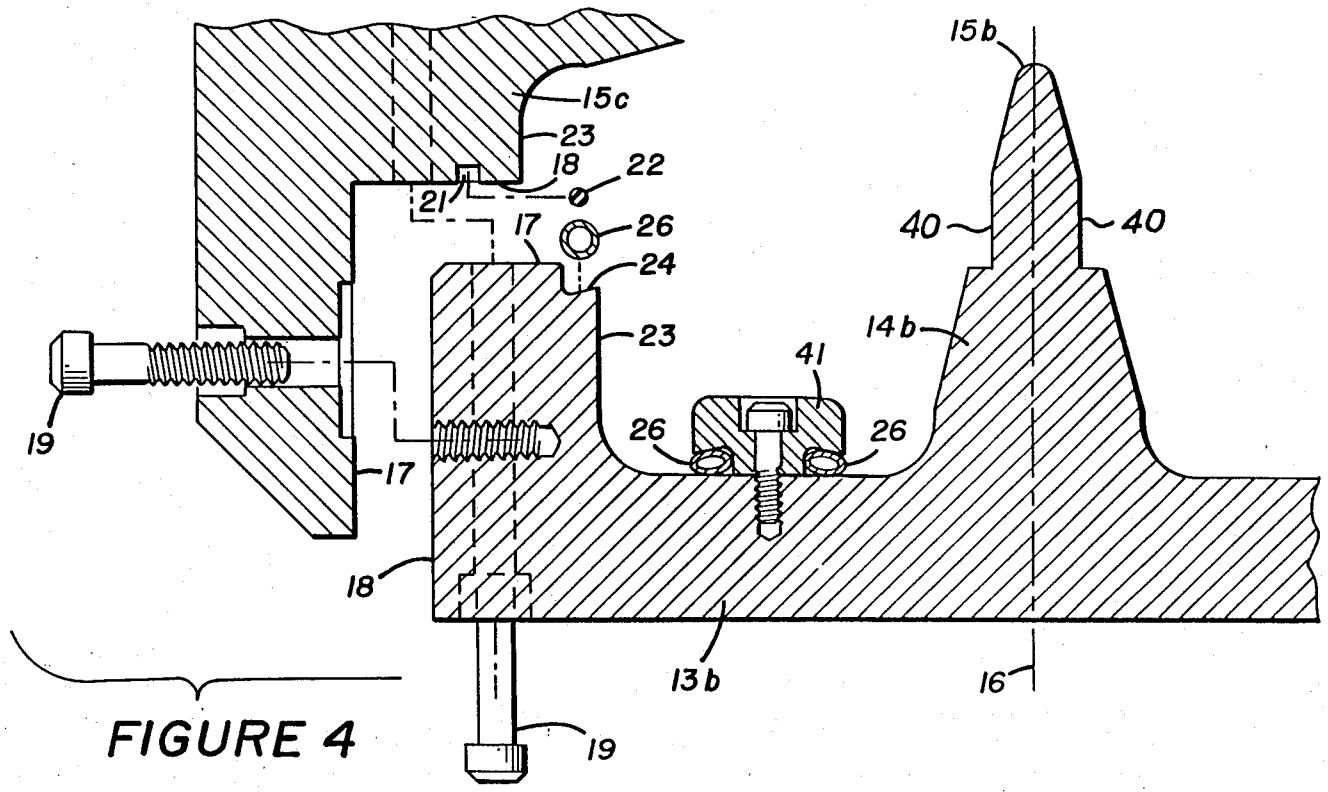
FIG. 4 is an exploded view of a corner portion of the quadrupole of FIG. 1, to illustrate the manner of assembly thereof.

As best seen in FIGS. 2 and 4, each of the walls **13*a–d* and the vanes 14*a–d* integral therewith, constitute a separate structural element, each element having a central lengthwise plane 16 extending through the middle of the vane tips thereof. Each of the walls 13*a–d* has two first flat surfaces 17 normal to its central plane and extending the length of the wall on opposite sides of the central plane. Similarly, each of the walls 13*a–d* has two second flat surfaces 18 parallel to its central plane and extending the length of the wall on opposite sides of the central plane. When the walls 13*a–d* are assembled together, and held by machine screws 19, a first and second flat surfaces 17 and 18 on a wall, on one side of the central plane 16 thereof, will butt against a second and first flat surfaces 18 and 17**, respectively on the adjacent wall.

At each joint between adjacent walls, one of the flat surfaces could have the option of a groove 21 along the length thereof which could receive an O-ring 22 so that the interior of the assembled device may be vacuum tight. In each such case, the ends of the quadrupole walls would have an O-ring **22*a* received therein (FIG. 1**) for a vacuum tight seat with planar end plates (not shown).

Also at each joint between adjacent walls, the inner surface 23 of one of the joining walls has an undercut groove 24 along the length thereof to receive a canted coil RF spring 26. These springs are conventionally used at junctures between joining surfaces to provide an RF connection between the surfaces for flow of skin current and to thus prevent arcing which would occur at any gaps between the inner surfaces of the joining surfaces. The springs 26 are preferably silver plated to enhance their conduction.

As best seen in FIG. 2, the inner surfaces 23 of the walls 13*a–d* and vanes 14*a–d* integral therewith define four substantially equal cavities 27*a–d* each of which allows electromagnetic resonance at the quadrupole operating frequency. Merely by way of illustration, a quadrupole is shown in FIG. 2 with a total external height of 7.5 inches and a total external width of 9.8 inches. The internal cavities thus formed will be resonant at approximately 400 megahertz. Depending upon its particular use, such a quadrupole will normally have a length somewhere between 2 to 10 feet long.

For certain power applications, cooling plates 28 are mounted on the walls 13*a–d* centrally along the length thereof. As shown in FIG. 2, the plates 28 each have a length-wise recess 29, closed at its ends and with openings 31 through the plate to allow a cooling fluid to flow through the recess and absorb heat from the quadrupole. The integral construction of the walls and vanes provide for maximum heat conduction from the vanes to the walls.

A vacuum in the interior of the quadrupole is required for particle beam transmission. Passages 32 through wall 13*a*, near one end thereof, communicate cavities 27*a* and 27*b* with the chamber 33 in the manifold plate 34. Chamber 33 is connected through opening 36, line 37, and valve 38 to vacuum pump 39. In like manner, cavities 27*c* and 27*d* could be connected to a second vacuum pump (not shown) if required. The vacuum may also be achieved by installing the complete quadrupole inside a vacuum chamber.

FABRICATION

Each wall portion and integral vane is fabricated from a single piece of metal plate. Conventional, modern-accuracy machine tools and techniques may be used for fabrication. A numerically controlled milling machine for example may be used to machine the complete geometry of the quadrupole.

Typically the vane tips will be machined with width and height modulations along its length to provide a desired field pattern along the length of the central axis 12 of the quadrupole. The fiducial flats 40, spaced from the vane tips and parallel to the central plane of the vanes, provide high precision reference surfaces from which the location of the vane modulations may be accurately verified.

The quadrupole may be made of a material of high electrical conductivity such as copper, or it may be made of steel or aluminum with all the inner surfaces plated with copper or silver. If the quadrupole is plated, the flat surfaces 17 and 18 on the wall edges are masked during plating and left un-plated to maintain the dimensional accuracy required for assembly. Preferably the vane tips are plated with only a thickness of 0.0002 to 0.0005 inches of a strike coat of cyanide copper to reduce plating build-up and thereby maintain the precision of the vane tip modulations. All other copper surfaces are preferably acid plated copper with a thickness of 0.001 to 0.004 inches.

ASSEMBLY

All critical dimensions on each wall-vane part are verified for accuracy before and after plating.

If RF tuning bars 41 (FIG. 4) are to be installed in the cavities, these are installed at this time. These bars, which extend lengthwise of the quadrupole may be used in each cavity to decrease the cross-sectional area of the cavities and thus increase their resonant frequency. The tuning bars are bolted to the inner wall surface, and central springs 26 are used to provide highly conducting RF joints between both sides of the tuning bar and the inner surface 23 of the wall. This installation is greatly facilitated because the entire length of the inner surface 23 of the wall is exposed at this time.

The four wall-vane parts are now assembled and bolted together, with the O-rings 21 and RF springs 26 in place and with the unplated flat surfaces 17 and 18 bolted against each other. A conventional bore measuring instrument can be inserted along the longitudinal axis to verify the proper spacing between opposing vane tips.

Cooling plates 28, vacuum manifolds 34, and the unshown RF drive, monitoring loops, tracker loop, vane coupling rings, end plates and other elements known to those skilled in the art can be installed. The RF drive typically includes an RF loop (not shown) inserted into one of the cavities 27*a–d* which when driven will induce a resonating current along the length of the cavities which flows back and forth between the tips which terminate the cavities and thusly produce control of the particle beam.

The above-described quadrupole has a number of significant advantages. Prior to assembly, the interior surfaces of the wall-vane parts are fully exposed, making it easy to verify the accuracy of the machined surfaces, and to add (or remove) RF tuning bars 41.

With the vane tip modulations verified relative to the flat mounting surfaces 17 and 18, the four wall-vane parts may be easily assembled together, with no further adjustment being needed to position the vane tips relative to each other.

If RF tuning bars 41 are not used, the assembled quadrupole has only four RF joints. This will increase the Q of the cavities and will thus lower the RF power requirements.

The cost of critical spare parts is reduced, since the design shown herein uses only two physically different wall-vane parts to make the completed quadrupole. Further, the quadrupole can be easily disassembled and reassembled with one or more spare wall-vane parts, with the reassembled quadrupole requiring no adjustment to provide the proper spacing of the four vane tips.

The foregoing description of the preferred embodiment has been presented for purposes of illustration and description. It is not intended to be exhaustive or to limit the invention to the precise form described, and obviously many other modifications are possible in light of the above teaching. For example, the quadrupole may be designed so that the wall of a wall-vane part is not symmetrical relative to the central plane of the part. The embodiment was chosen in order to explain most clearly the principles of the invention and its practical applications thereby to enable others in the art to utilize most effectively the invention in various other embodiments and with various other modifications as may be suited to the particular use contemplated. It is intended that the scope of the invention be defined by the claims appended hereto.

What is claimed is:

1. A radio frequency quadrupole comprising:

four separate structural elements each having a wall and a vane integral therewith, the walls of said four structural elements butting against each other to form an elongated housing having an elongate central axis and top, bottom and two side walls symmetrically disposed about said central axis, the vanes integral with said top and bottom walls constituting a first pair of vanes projecting from said top and bottom walls and extending lengthwise along said walls, said vanes of said first pair each having a cross-section substantially at right angles to said central axis which tapers inwardly towards said central axis to form a first pair of blade-shaped confronting tips spaced apart by a first predetermined distance, the vanes integral with said side walls constituting a second pair of vanes projecting from said side walls and extending lengthwise along said side walls, said vanes of said second pair each having a cross-section normal to said central axis which tapers inwardly towards said central axis to form a second pair of blade-shaped confronting tips spaced apart by a second predetermined distance and at substantially right angles to said first pair of tips, each structural element having a central lengthwise plane passing through the tip of the vane of said structural element, each structural element having two first flat surfaces on its wall, said first flat surfaces being normal to the central plane of said structural element, one on each side of said central plane and extending the length of the wall, each structural element having two second flat surfaces on its wall, said second flat surfaces being parallel to the central plane of said structural element, one on each side of said central plane and extending the length of the wall, each of the walls of said four structural elements having the first and second flat surfaces thereof butted against the second and first flat surfaces, respectively, of the walls adjacent thereto, each of the vanes of said four structural elements having two flat surfaces thereon parallel to its central plane and spaced from its tip, said flat surfaces extending the length of said vane, one on each side of said central plane, to provide high precision reference surfaces from which the location of vane modulations on the vane tips may be accurately verified.

2. A radio frequency quadrupole as set forth in claim 1, wherein each of said structural elements is symmetrical about the central plane of the vane thereof.

* * * * *